US010960518B1

(12) United States Patent
Barraco et al.

(10) Patent No.: US 10,960,518 B1
(45) Date of Patent: Mar. 30, 2021

(54) INSERTS FOR SHIELDING ALUMINUM VEHICLES FROM CLAMPS

(71) Applicants: Anthony M. Barraco, Islip, NY (US); Scott Saal, Deer Park, NY (US)

(72) Inventors: Anthony M. Barraco, Islip, NY (US); Scott Saal, Deer Park, NY (US)

( * ) Notice: Subject to any disclaimer, the term of this patent is extended or adjusted under 35 U.S.C. 154(b) by 0 days.

(21) Appl. No.: 16/658,486

(22) Filed: Oct. 21, 2019

Related U.S. Application Data

(60) Provisional application No. 62/903,368, filed on Sep. 20, 2019.

(51) Int. Cl.
*B25B 1/24* (2006.01)
*B25B 5/16* (2006.01)
*B25B 5/02* (2006.01)

(52) U.S. Cl.
CPC ..... *B25B 5/163* (2013.01); *B25B 1/2405* (2013.01); *B25B 1/2452* (2013.01); *B25B 5/02* (2013.01); *Y10S 72/705* (2013.01)

(58) Field of Classification Search
CPC ..... B25B 1/2405; B25B 1/2452; B25B 1/241; B25B 1/24; B25B 5/163; B25B 5/02; B25B 5/16; B25B 1/2457; B25B 1/2463; B25B 13/58; E21B 19/10; E21B 33/129; Y10S 294/90; Y10S 72/705; B21D 1/145; B21D 25/04; B21D 1/12; Y10T 24/44974; Y10T 24/44684
USPC ..... 269/271, 86; 81/185.1; 72/705, 457, 72/302, 422; 294/116; D8/72
See application file for complete search history.

(56) References Cited

U.S. PATENT DOCUMENTS 860,949 A * 7/1907 Walters ..... B25B 13/5058 81/105
884,422 A * 4/1908 Schmitt ..... B25B 7/04 81/316
3,184,999 A * 5/1965 Capra ..... B25B 13/5058 81/101
3,355,777 A * 12/1967 Mojelski ..... B60D 1/04 24/116 R
3,594,706 A 7/1971 Sotolongo
3,986,746 A * 10/1976 Chartier ..... B21D 25/04 294/116
4,315,424 A * 2/1982 Jarman ..... B21D 25/04 24/523

(Continued)

FOREIGN PATENT DOCUMENTS

EP 1889998 A1 2/2008
EP 2524767 B1 7/2014

(Continued)

OTHER PUBLICATIONS

Galvanic Corrosion and Cross Contamination (Year: 2007).*

(Continued)

*Primary Examiner* — Orlando E Aviles
*Assistant Examiner* — Mahdi H Nejad
(74) *Attorney, Agent, or Firm* — Carter, DeLuca & Farrell LLP

(57) ABSTRACT

An upper, aluminum insert is positioned between an upper, non-aluminum jaw of a clamp and an aluminum part of a vehicle, and a lower, aluminum insert is positioned between a lower, non-aluminum jaw of the clamp and the aluminum part of the vehicle to shield the aluminum part of the vehicle from the jaws to prevent galvanic corrosion.

4 Claims, 4 Drawing Sheets

(56) References Cited

U.S. PATENT DOCUMENTS

| | | | | |
|---|---|---|---|---|
| 4,576,067 | A * | 3/1986 | Buck | E21B 19/161 269/283 |
| 4,823,919 | A * | 4/1989 | Hayatdavoudi | E21B 19/10 188/244 |
| 4,898,371 | A * | 2/1990 | Mills | B25B 1/103 269/136 |
| 4,941,765 | A * | 7/1990 | Horan | B21D 1/145 248/352 |
| 6,334,252 | B1 * | 1/2002 | Sato | B23K 26/0838 29/897.2 |
| 7,036,397 | B2 * | 5/2006 | Bangert | E21B 19/07 81/57.15 |
| 7,055,357 | B2 * | 6/2006 | Weschler | B21D 1/145 72/305 |
| 8,550,411 | B2 | 10/2013 | Hiss et al. | |
| 9,296,090 | B2 * | 3/2016 | Bronzino | B25B 1/241 |
| D790,309 | S * | 6/2017 | Liao | D8/72 |
| 10,145,186 | B2 * | 12/2018 | Fuehring | E21B 19/06 |
| 10,300,568 | B2 * | 5/2019 | Kousens | B23Q 3/061 |
| 2008/0238151 | A1 * | 10/2008 | Nakamura | B62D 25/04 296/203.03 |
| 2014/0284862 | A1 * | 9/2014 | Bettencourt | B25B 1/2452 269/282 |
| 2015/0217821 | A1 * | 8/2015 | Campbell | B23K 11/115 29/428 |
| 2016/0089767 | A1 * | 3/2016 | Zaehnle | B25B 1/241 29/428 |
| 2018/0050419 | A1 * | 2/2018 | Das | B23K 20/1255 |
| 2018/0266617 | A1 | 9/2018 | Yoon et al. | |
| 2019/0337567 | A1 * | 11/2019 | Chevalier | B62D 21/11 |

FOREIGN PATENT DOCUMENTS

| | | | |
|---|---|---|---|
| GB | 2157203 | A | 10/1985 |
| SU | 1707317 | A1 | 1/1992 |

OTHER PUBLICATIONS

Mo Clamps, catalog (Year: 2012).*

2015 Ford F-150 Aluminum Structural Repair (Year: 2014).*

International Search Report dated Dec. 3, 2020, issued in corresponding International Appln. No. PCT/US2020/051208, 8 pages.

* cited by examiner

INSERTS FOR SHIELDING ALUMINUM VEHICLES FROM CLAMPS

CROSS-REFERENCE TO RELATED APPLICATION

This application claims the benefit of and priority to U.S. Provisional Patent Application No. 62/903,368, filed on Sep. 20, 2019, the entire contents of which being incorporated by reference herein.

TECHNICAL FIELD

The present disclosure generally relates to aluminum inserts, and more particularly to aluminum inserts for shielding an aluminum part of a vehicle from non-aluminum clamp jaws.

BACKGROUND

Typically, the main material used in building vehicles is steel. However, the automobile industry is paying more attention to fuel efficiency, weight, reducing CO2 emissions, and design. Therefore, aluminum is now playing an important role in modern vehicles more than ever because aluminum is light, strong, and flexible.

In the collision repair industry, the changes to the materials used for manufacturing vehicles have necessitated new repair procedures. When performing an aluminum repair, parts may become contaminated with steel particles if the technician does not use a tool made from the same material as the part he or she is repairing. Therefore, in order to carry out proper repairs, all aluminum repairs must be made with tools that are aluminum because only aluminum tools can touch aluminum vehicle parts during the repair process.

If steel particles get into the aluminum panel, for example, an electrolytic process called galvanic corrosion may occur. Galvanic corrosion is a process where one metal corrodes when it is in contact with a dissimilar material. The aluminum will corrode around the steel contaminations and min the paint and the structural integrity of the aluminum on the finished vehicle. In order to prevent this problem from occurring, a separate set of working tools should be maintained.

Frame or unibody damage is quite common in most auto accidents. Vehicles in accidents usually have a frame, a body, or unibody structures that need to be straightened. Vehicle straightening involves using high-powered hydraulic equipment, mechanical clamps, chains, and measuring systems. Clamps and chains are attached to the damaged areas and a hydraulic system pulls out the damage. Clamps are bolted to the specific points on the vehicle to distribute pulling force to prevent the frame or unibody from moving. One end of the pulling chain is fastened to the hydraulic ram, and the other to pulling clamps to pull the frame or unibody back to the manufacturer's specifications.

Therefore, aluminum tools will now have a major role in more than one aspect of the collision repair industry. To repair vehicles that contain aluminum parts, the repair shop will be required to use aluminum specific tools. This will eliminate the transfer of oxidation from aluminum to steel if everyday body repair tools are used. For these reasons, separate tools are required for the repair of aluminum vehicles.

SUMMARY

In one embodiment, in accordance with the principles of the present disclosure, an insert for shielding an aluminum part of a vehicle from a non-aluminum clamp is provided. The insert includes a rigid and planar body having an upper surface defining a plurality of teeth, and a lower surface defining a plurality of teeth. The teeth of the upper surface or the lower surface are configured to engage an aluminum part of a vehicle, and the teeth of the other of the upper surface or the lower surface are configured to detachably, matingly engage corresponding teeth of a jaw of a clamp. The upper surface and/or the lower surface of the insert is aluminum.

In some aspects, the body may be fabricated from aluminum. In aspects, the entire insert may be monolithically formed from aluminum.

In some aspects, the teeth of the upper surface may be parallel with one another.

In some aspects, the teeth of the upper surface may extend along a longitudinal axis defined by the body.

In some aspects, adjacent teeth of the upper surface may define a gap therebetween configured to receive a tooth of the jaw of the clamp.

In some aspects, the upper surface or the lower surface may have an identifying feature for differentiating the upper and lower surfaces from one another.

In some aspects, the identifying feature may be a coating or a marking.

In some aspects, the teeth of the upper surface may be angled in a generally forward direction, and the teeth of the lower surface may be angled in a generally rearward direction.

In accordance with another aspect of the present disclosure, a system for temporarily shielding an aluminum part of a vehicle from a non-aluminum clamp during an auto repair is provided. The system includes an upper insert and a lower insert. Each of the upper and lower inserts has an upper surface and a lower surface defining a plurality of teeth. The teeth of the upper surface of the upper insert are configured to detachably, matingly engage a corresponding plurality of teeth of an upper jaw of a clamp. The teeth of the lower surface of the upper insert are configured to engage a first side of an aluminum part of a vehicle. The teeth of the upper surface of the lower insert are configured to engage a second side of the aluminum part of the vehicle. The teeth of the lower surface of the lower insert are configured to detachably, matingly engage a corresponding plurality of teeth of a lower jaw of the clamp. At least the lower surface of the upper insert and the upper surface of the lower insert are aluminum.

In some aspects, the upper and lower inserts may each be fabricated from aluminum.

In some aspects, the teeth of the upper surface of the upper insert and the teeth of the lower surface of the lower insert may be parallel with one another.

In some aspects, the teeth of the upper surface of the upper insert may extend along a longitudinal axis defined by the upper insert, and the teeth of the lower surface of the lower insert may extend along a longitudinal axis defined by the lower insert.

In some aspects, adjacent teeth of the upper surface of the upper insert may define a gap therebetween configured to receive a tooth of the upper jaw of the clamp, and adjacent teeth of the lower surface of the lower insert may define a gap therebetween configured to receive a tooth of the lower jaw of the clamp.

In some aspects, the upper surface or the lower surface of the upper insert may have an identifying feature for differentiating the upper and lower surfaces of the upper insert from one another, and the upper surface or the lower surface of the lower insert may have an identifying feature for differentiating the upper and lower surfaces of the lower insert from one another.

In some aspects, the identifying feature of each of the upper and lower inserts may be a coating or a marking.

In some aspects, the teeth of the upper surface of the upper insert and the teeth of the lower surface of the lower insert may be angled in a generally forward direction, and the teeth of the lower surface of the upper insert and the teeth of the upper surface of the lower insert may be angled in a generally rearward direction.

In accordance with yet another aspect of the present disclosure, a method of engaging a non-aluminum clamp with an aluminum part of a vehicle is provided. The method includes positioning an upper insert between an upper jaw of a clamp and a first side of an aluminum part of a vehicle; positioning a lower insert between a lower jaw of the clamp and a second side of the aluminum part; and approximating the upper and lower jaws, thereby frictionally engaging an aluminum lower surface of the upper insert with the first side of the aluminum part and frictionally engaging an aluminum upper surface of the lower insert with the second side of the aluminum part.

In some aspects, positioning the first insert may include matingly engaging a plurality of teeth defined by an upper surface of the upper insert with a corresponding plurality of teeth of the upper jaw. Positioning the second insert may include matingly engaging a plurality of teeth defined by a lower surface of the lower insert with a corresponding plurality of teeth of the lower jaw.

In some aspects, frictionally engaging the aluminum lower surface of the upper insert with the first side of the aluminum part may include frictionally engaging a plurality of teeth defined by the lower surface of the upper insert with the first side of the aluminum part. Frictionally engaging the aluminum upper surface of the lower insert with the second side of the aluminum part may include frictionally engaging a plurality of teeth defined by the upper surface of the lower insert with the second side of the aluminum part.

In some aspects, the method may further include separating the upper and lower jaws; moving the first and second sides of the aluminum part out from between the upper and lower jaws; and detaching the upper and lower inserts from the respective upper and lower jaws.

As used herein, the terms parallel and perpendicular are understood to include relative configurations that are substantially parallel and substantially perpendicular up to about + or −20 degrees from true parallel and true perpendicular.

BRIEF DESCRIPTION OF THE DRAWINGS

The present disclosure will become more readily apparent from the specific description accompanied by the following drawings, in which.

DETAILED DESCRIPTION

Figure 1:
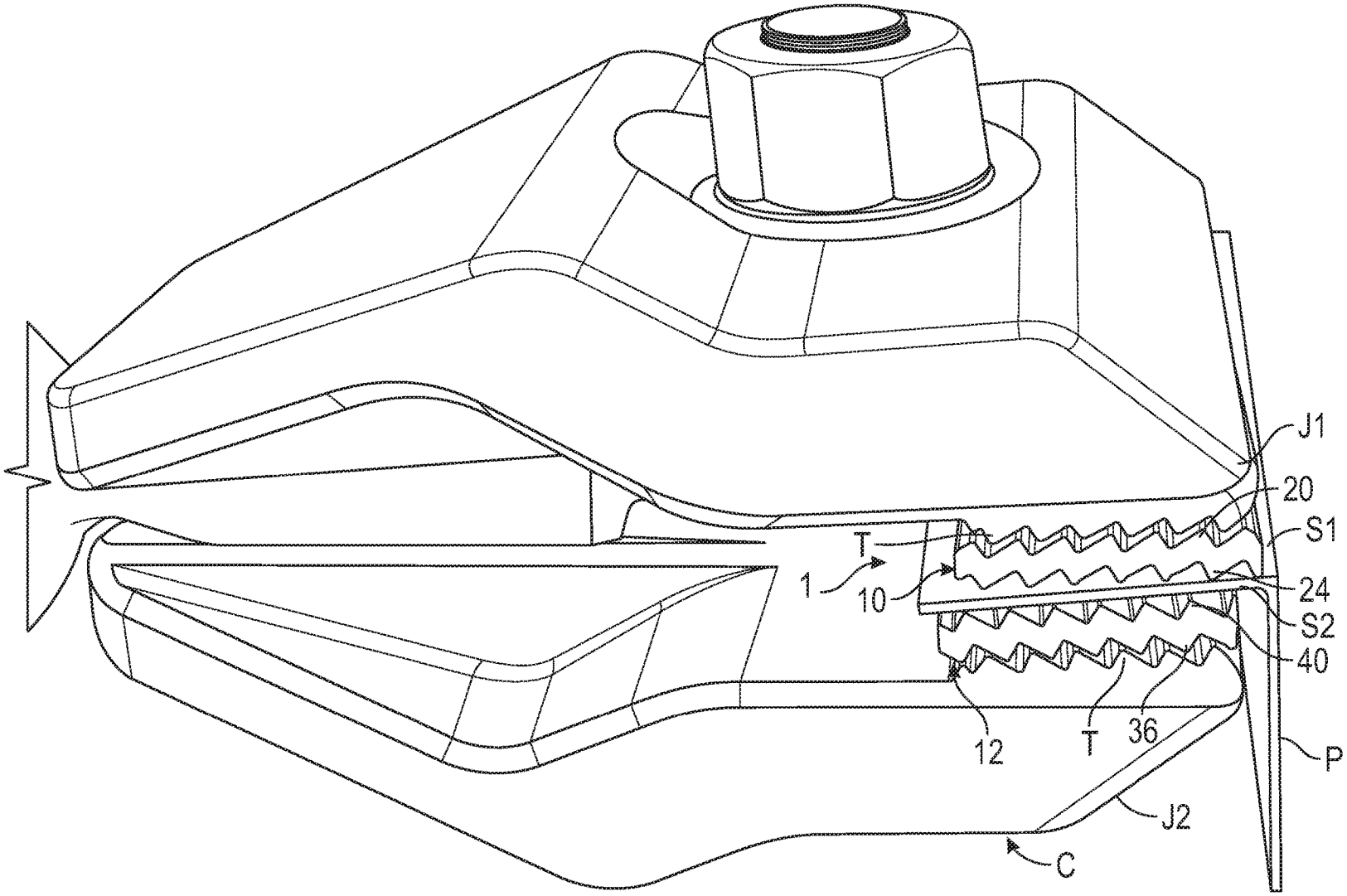
FIG. 1 is a side view illustrating an exemplary embodiment of a pair of upper and lower inserts shielding an aluminum part from steel surfaces of a clamp.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The present disclosure generally provides an aluminum isolator insert. The insert(s) may be used with an existing steel clamp tool for pulling body parts, frames or unibodies of a damaged aluminum vehicle. The insert is made from aluminum to prevent galvanic corrosion from occurring by preventing contact between the steel clamp and the aluminum part of the vehicle. In use, an existing clamp is opened, and the aluminum isolator insert is inserted inside the clamp to use on vehicles that have aluminum parts that need to be repaired or replaced.

The aluminum isolator insert will allow auto body repair technicians to use their existing clamps. With this aluminum isolator insert there will be no extra cost to have a separate set of clamps for pulling aluminum vehicles. The original clamps and the aluminum isolator insert may be inserted directly into the existing clamp. The repair technician will be prepared to do the correct aluminum repairs to the vehicle while avoid cross contamination from the repair tools.

The insert, or selected surfaces thereof, is fabricated from aluminum and intended for use with clamps in the pulling of body part frames and in bodies on a vehicle that were damaged in a collision accident. The inserts may be a pair of aluminum plates, which can be inserted into a clamp, with one plate placed on the top of the opened clamp and the other plate placed on the bottom of the opened clamp. With the inserts properly positioned, the clamp may be closed to attach to the part on the vehicle that needs to be repaired. The inserts prevent the aluminum part being repaired from contacting the non-aluminum (e.g., steel) surfaces of the clamp.

The insert may have a grooved design on each side. The grooved design allows the insert to stay attached to the clamp and the aluminum vehicle part when the aluminum vehicle part is being repaired. One side of the insert may have an uncoated aluminum substrate finish and the other side may have a color coated finish to assist the technician with properly positioning the inserts in the clamp. When inserting the inserts, the color-coated finished side of the insert will be engaged with the steel surface of the clamp, whereas the uncoated aluminum substrate side of the insert will be engaged to the aluminum part being repaired to ensure that only aluminum is touching the aluminum surfaces of the vehicle. The inserts shield or insulate the steel surfaces of the clamp from contact with the aluminum surfaces of the clamp, thereby preventing galvanic corrosion from occurring. That is, the inserts create a physical barrier between the clamp and the aluminum surfaces of the vehicle being grasped between the jaws of the clamp. The inserts will allow collision repairs to be made professionally and correctly while also allowing the technician to use the clamps that the technician or shop already has on-hand.

Figure 2:
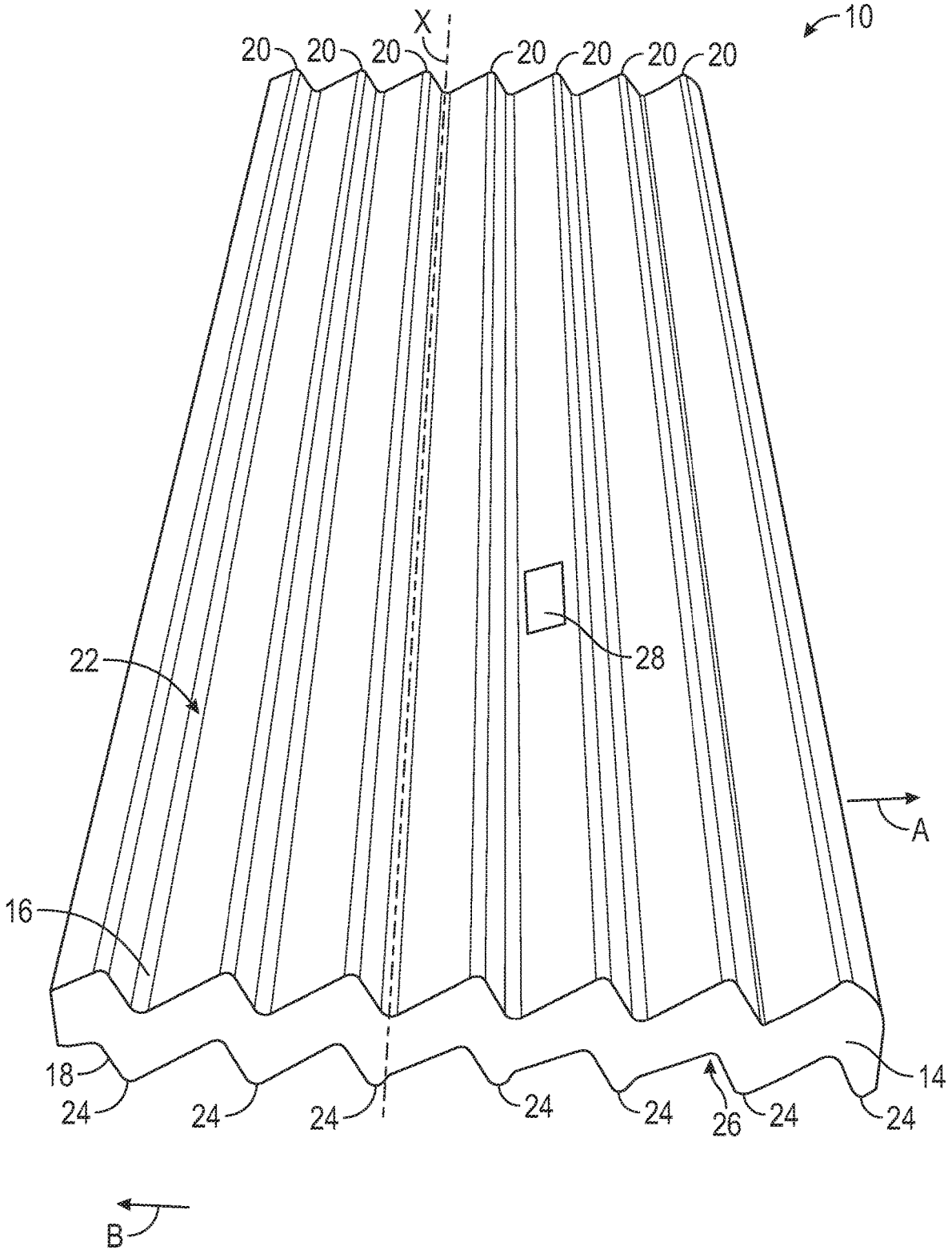
FIG. 2 side, perspective view illustrating the upper insert shown in FIG. 1.
Figure 3:
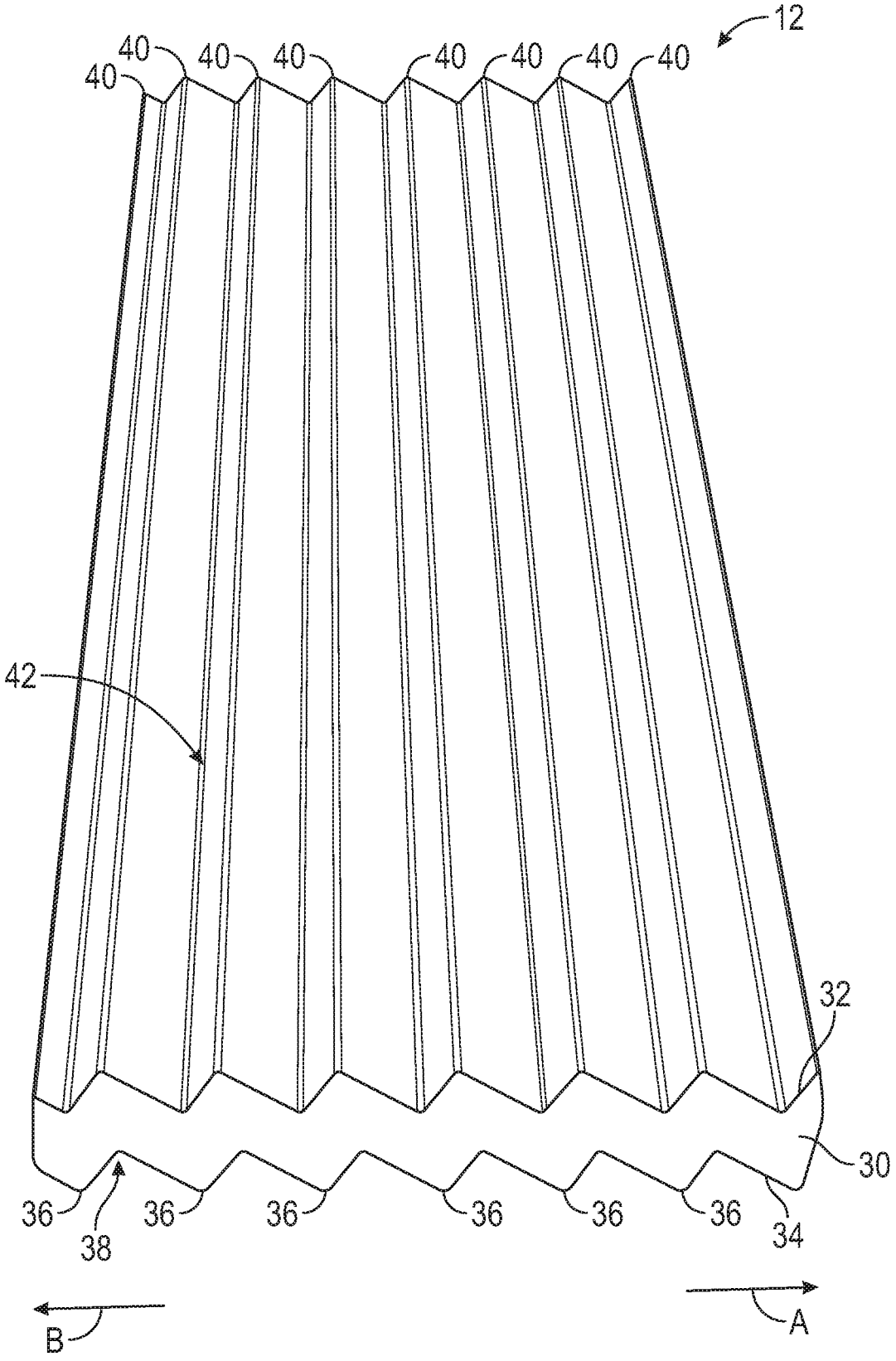
FIG. 3 is a side, perspective view illustrating the lower insert shown in FIG. 1.

With reference to FIGS. 1-3, illustrated is an exemplary embodiment of a system 1 including a pair of upper and lower inserts 10, 12 for shielding an aluminum part "P" of a vehicle from non-aluminum (e.g., steel) jaws "J1," "J2" of a clamp "C" during an auto repair. The upper insert 10 includes a rigid and planar aluminum body 14 having an upper surface 16 and an opposing lower surface 18. The body 14 may be rectangular in shape having a length that is substantially the same as a width of an upper jaw "J1" of a standard steel pulling clamp "C" (FIG. 1) and a width that is substantially the same as the length (measured from rearward to forward) of the upper jaw "J1" of the standard pulling clamp "C." In aspects, the body 14 may be fabricated from other suitable rigid materials, such as polyetherimide or polyether ether ketone. In aspects, the body may assume any suitable shape.

The upper surface 16 defines a plurality of teeth 20 configured to detachably, matingly engage a corresponding plurality of teeth "T" of the upper jaw "J1" of the clamp "C." The teeth 20 may be parallel ridges that extend longitudinally along a longitudinal axis "X" defined by the body 14. The teeth 20 may have a triangular transverse cross-sectional configuration and extend in a generally forward direction, indicated by arrow "A" in FIG. 2. The teeth 20 extend in the forward direction to engage the rearwardly extending teeth "T" of the upper jaw "J1" of the clamp "C." In aspects, the teeth 20 may assume any other suitable transverse cross-sectional configuration, such as, rounded, squared, or the like. Adjacent teeth 20 define a gap 22 therebetween configured for receipt of a corresponding tooth or ridge of the upper jaw "J1" of the clamp "C." In other aspects, the teeth 20 may be a plurality of spikes extending upwardly from the upper surface 16. Other suitable shapes and patterns for the teeth 20 are also contemplated.

The lower surface 18 of the insert 10 may be coated with, fabricated from, or otherwise have aluminum or some other suitable material that does not react with aluminum (e.g., PEEK). In aspects, the entire insert 10, including the lower surface 18, may be fabricated from aluminum. The lower surface 18 defines a plurality of teeth 24, similar to the teeth 20 of the upper surface 16. The teeth 24 are configured to engage a first side "S1" (FIG. 1) of the aluminum part "P" of a vehicle. The teeth 24 may have a triangular transverse cross-sectional configuration and are angled in a generally rearward direction, indicated by arrow "B" in FIG. 2, to facilitate grasping, holding, and/or pulling the aluminum part "P" of the vehicle. In aspects, the teeth 24 may assume any other suitable transverse cross-sectional configuration, such as, rounded, squared, or the like. Adjacent teeth 24 define a gap 26 therebetween configured for receipt of a corresponding tooth or ridge of the upper jaw "J1" of the clamp "C." In other aspects, the teeth 24 may be a plurality of spikes extending downwardly from the lower surface 18. Other suitable shapes and patterns for the teeth 24 are also contemplated.

The upper surface 16 of the upper insert 10 has an identifying feature 28 for differentiating the upper surface 16 from the lower surface 18 to ensure a technician correctly orients the upper insert 10 in the clamp "C." If, for example, the technician inadvertently positions the upper surface 16 of the upper insert 10 face down, contamination may result if the upper surface 16 had previously engaged the upper jaw "J1." The identifying feature 28 may be a coating of paint or the like, or a marking such as an engraving.

With reference to FIGS. 1 and 3, the second or lower insert 12 is substantially similar or identical to the upper insert 10, and therefore will only be described in the detail necessary to elucidate certain differences. The lower insert 12 has a rigid and planar body 30 having an upper surface 32 and an opposing lower surface 34. The body 30 may be rectangular in shape having a length that is substantially the same as a width of a lower jaw "J2" of the standard steel pulling clamp "C" (FIG. 1) and a width that is substantially the same as the length (measured from rearward to forward) of the lower jaw "J2" of the standard pulling clamp "C." In aspects, the body 30 may be fabricated from other suitable non-reactive rigid materials, such as polyetherimide or polyether ether ketone. In aspects, the body 30 may assume any suitable shape.

The lower surface 34 of the lower insert 12 defines a plurality of teeth 36 configured to detachably, matingly engage a corresponding plurality of teeth "T" of the lower jaw "J2" of the clamp "C." The teeth 36 are angled in the forward direction "A" to engage the rearwardly extending teeth "T" of the lower jaw "J2" of the clamp "C." Adjacent teeth 36 define a gap 38 therebetween configured for receipt of a corresponding tooth or ridge of the lower jaw "J2" of the clamp "C."

The upper surface 32 of the lower insert 12 may be coated with, fabricated from, or otherwise have aluminum or some other suitable material that does not react with aluminum. In aspects, the entire lower insert 12, including the upper surface 32, may be fabricated from aluminum. The upper surface 32 defines a plurality of teeth 40, similar to the teeth 36 of the lower surface 34. The teeth 40 are configured to engage a second side "S2" (FIG. 1) of the aluminum part "P" of the vehicle. The teeth 40 are angled in a generally rearward direction "B" to facilitate grasping, holding, and/or pulling the aluminum part "P" of the vehicle. Adjacent teeth 40 define a gap 42 therebetween configured for receipt of a corresponding tooth or ridge of the lower jaw "J2" of the clamp "C."

The lower surface 34 of the lower insert 12 has an identifying feature (not explicitly shown) for differentiating the lower surface 34 from the upper surface 32 to ensure a technician correctly orients the lower insert in the clamp "C." If, for example, the technician inadvertently positions the lower surface 34 of the lower insert 12 face up, contamination may result if the lower surface 34 had previously engaged the lower jaw "J2." The identifying feature may be a coating of paint or the like, or a marking such as an engraving. It is contemplated that the upper and lower inserts 10, 12 have an additional identifying feature to allow a technician to distinguish between the upper and lower inserts 10, 12. For example, the additional identifying feature may be a marking of the letter "U" on the upper insert 10 and a letter "L" on the lower insert 12. In aspects, the identifying feature may serve the dual purpose of distinguishing between upper and lower inserts 10, 12 and upper and lower surfaces of each.

In use, an aluminum part "P" of an aluminum vehicle, such as a body, frame, or any other selected part, may need to be grasped by the clamp "C" during a repair of the aluminum vehicle. Since most clamps are steel, grasping the part "P" with the steel clamp is likely to contaminate the aluminum part "P" and result in galvanic corrosion. The system 1 of the present disclosure may be used to create a physical barrier between the part "P" and the clamp "C."

In particular, the upper insert 10 is positioned between the upper jaw "J1" of the clamp "C" and the first side "S1" of the aluminum part "P" of the vehicle, and the lower insert 12 is positioned between the lower jaw "J2" of the clamp "C" and the second side "S2" of the aluminum part "P." When the upper insert 10 is positioned in the clamp "C," the teeth 20 of the upper surface 16 of the upper insert 10 matingly engage corresponding teeth "T" of the upper jaw "J1," and when the lower insert 12 is positioned in the clamp "C," the teeth 36 of the lower surface 34 of the lower insert 12 matingly engage corresponding teeth "T" of the lower jaw "J2."

With the upper and lower inserts 10, 12 disposed in the clamp "C," the upper and lower jaws "J1," "J2" are approximated, thereby frictionally engaging the aluminum lower surface 18 of the upper insert 10 with the first side "S1" of the aluminum part "P" and frictionally engaging the aluminum upper surface 32 of the lower insert 12 with the second side "S2" of the aluminum part "P." The teeth 24 of the lower surface 18 of the upper insert 10 and the teeth 40 of the upper surface 32 of the lower insert 12 hold the aluminum part "P" and prevent slipping thereof.

With the aluminum part "P" clamped by the clamp "C," the part "P" may be held in position or moved by moving the clamp "C" via an attached machine. After performing the repair or replacement, the upper and lower jaws "J1," "J2" are separated, thereby freeing the part "P" and allowing removal of the part "P" from the clamp "C." The upper and lower inserts 10, 12 are detached from the respective upper and lower jaws "J1," "J2" and ready for reuse. In aspects, the inserts 10, 12 may be cleaned to remove any non-aluminum debris therefrom.

Figure 4:
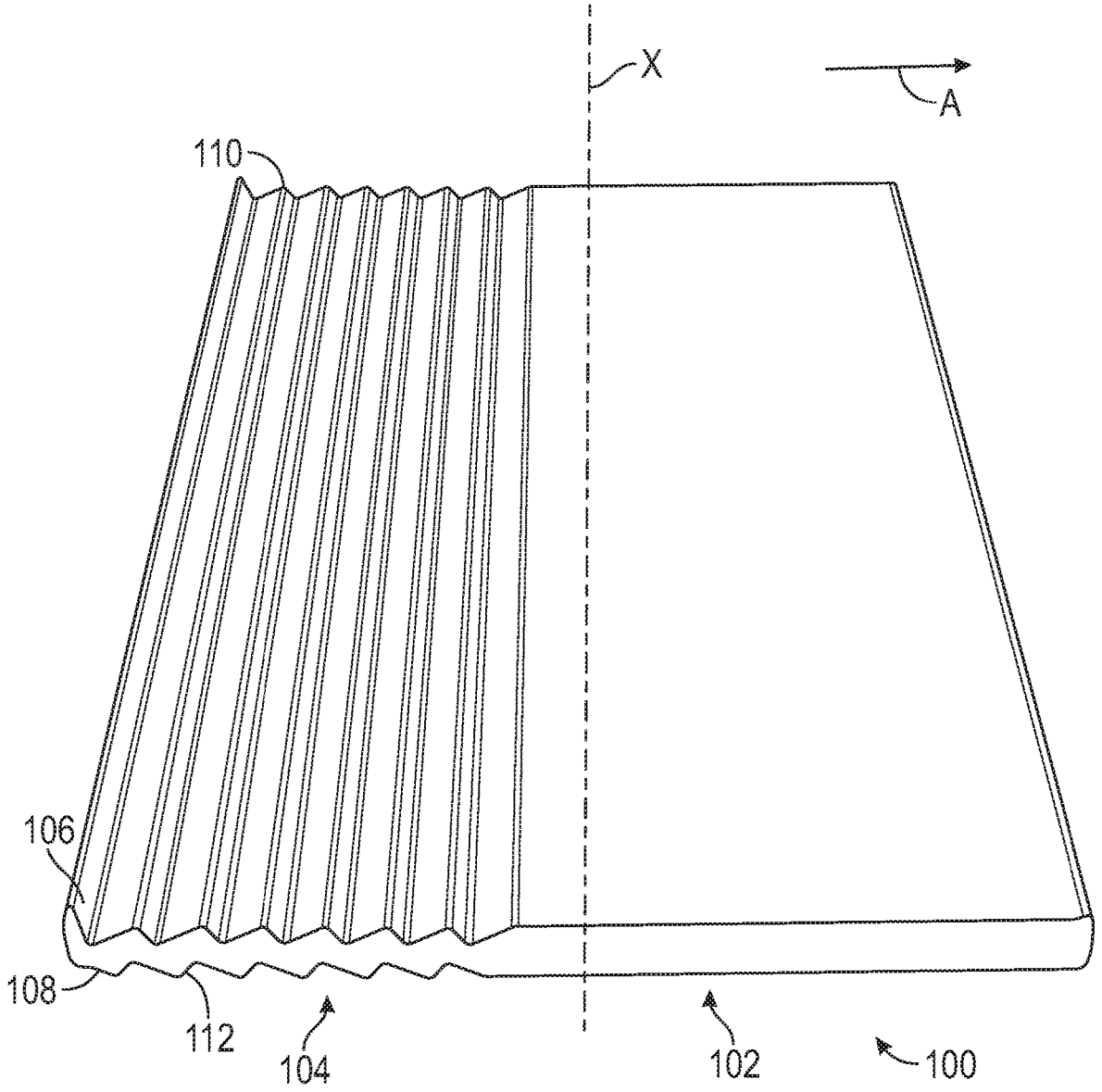
FIG. 4 is a side, perspective view of another embodiment of an insert configured for receipt between a pair of jaws of a steel clamp.

With reference to FIG. 4, illustrated is another embodiment of an aluminum insert 100 configured for receipt between the jaws "J1," "J2" of the clamp "C" (FIG. 1.) The insert 100 is similar to the inserts 10, 12 described above, and will therefore only be described in the detail necessary to elucidate certain differences. The insert 100 is intended to be used for removing dents/buckles in the body of an aluminum vehicle.

The insert 100 has a front end portion 102 and a rear end portion 104. The front end portion 102 is fabricated from aluminum or otherwise has an aluminum outer surface. The front and rear end portions 102, 104 are plate-like, rigid, and coplanar with one another.

The rear end portion 104 of the insert 100 has an upper surface 106 and an opposing lower surface 108. The upper and lower surfaces 106, 108 of the rear end portion 104 may be coated with, fabricated from, or otherwise have aluminum or some other suitable material that does not react with aluminum. In aspects, the entire insert 100 may be fabricated from aluminum. The upper surface 106 defines a plurality of teeth 110 configured to detachably, matingly engage the corresponding teeth "T" of the upper jaw "J1" of the clamp "C," and the lower surface 108 defines a plurality of teeth 112 configured to detachably, matingly engage the corresponding teeth "T" of the lower jaw "J1" of the clamp "C."

The teeth 110, 112 of the upper and lower surfaces 106, 108 may be parallel ridges that extend longitudinally along a longitudinal axis "X" defined by the insert 100. The teeth 110, 112 of the upper and lower surfaces 106, 108 may have a triangular transverse cross-sectional configuration and extend in a generally forward direction "A" to engage the rearwardly extending teeth "T" of the respective upper and lower jaws "J1," "J2" of the clamp "C." In aspects, the teeth 110, 112 of the upper and lower surfaces 106, 108 may assume any other suitable transverse cross-sectional configuration, such as, rounded, squared, or the like. In other aspects, the teeth 110, 112 of the upper and lower surfaces 106, 108 may be a plurality of spikes extending upwardly from the upper surface. Other suitable shapes and patterns for the teeth 110, 112 are also contemplated.

In use, to remove a dent, buckle, or the like in an aluminum body of a vehicle, the insert 100 may be utilized in conjunction with the clamp "C" of FIG. 1 or any other suitable clamp. In particular, the rear end portion 104 of the insert 100 is received between the jaws "J1," "J2" of the clamp "C" and the clamp "C" is closed to temporarily fix the insert 100 relative to the clamp "C." With the insert 100 held in position by the clamp "C," the front end portion 102 is positioned into engagement with the aluminum part of the vehicle having the dent. The front end portion 102 may then be welded to the aluminum part using aluminum. With the front end portion 102 welded to the dented part of the vehicle, the clamp "C" may be moved away from the vehicle, using a suitable machine, to fix the dent. Since at least the front end portion 102 of the insert 100 is fabricated from aluminum, only aluminum makes contact with the aluminum part of the vehicle, thereby preventing any contamination from the steel clamp "C."

After fixing the dent in the part of the vehicle, the weld between the insert 100 and the vehicle is severed to allow the technician to detach the insert 100 from the vehicle.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A method of repairing an aluminum part of a vehicle, the method comprising:

positioning an upper insert between a non-aluminum upper jaw of a clamp and a first side of the aluminum part of the vehicle, wherein positioning the first insert includes matingly engaging a plurality of teeth defined by an upper surface of the upper insert with a corresponding plurality of teeth of the upper jaw;

positioning a lower insert between a non-aluminum lower jaw of the clamp and a second side of the aluminum part, wherein positioning the second insert includes matingly engaging a plurality of teeth defined by a lower surface of the lower insert with a corresponding plurality of teeth of the lower jaw;

approximating the upper and lower jaws, thereby frictionally engaging an aluminum lower surface of the upper insert with the first side of the aluminum part and frictionally engaging an aluminum upper surface of the lower insert with the second side of the aluminum part, wherein frictionally engaging the aluminum lower surface of the upper insert with the first side of the aluminum part includes frictionally engaging a plurality of teeth defined by the lower surface of the upper insert with the first side of the aluminum part, and wherein frictionally engaging the aluminum upper surface of the lower insert with the second side of the aluminum part includes frictionally engaging a plurality of teeth defined by the upper surface of the lower insert with the second side of the aluminum part, wherein the plurality of teeth of the upper surface of the upper insert and the plurality of teeth of the lower surface of the lower insert are angled in a generally forward direction when the upper insert is engaged with the upper jaw and the lower insert is engaged with the lower jaw, and the plurality of teeth of the lower surface of the upper insert and the plurality of teeth of the upper surface of the lower insert are angled in a generally rearward direction when the upper insert is engaged with the upper jaw and the lower insert is engaged with the lower jaw; and moving the clamp with respect to the vehicle, thereby fixing a deformity of the aluminum part of the vehicle.

2. The method according to claim 1, further comprising:

separating the upper and lower jaws;

moving the first and second sides of the aluminum part out from between the upper and lower jaws; and detaching the upper and lower inserts from the respective upper and lower jaws.

3. The method according to claim 2, further comprising cleaning the upper and lower inserts to remove non-aluminum debris therefrom after the upper and lower inserts are detached from the respective upper and lower jaws.

4. The method according to claim 1, wherein the upper surface of the upper insert or the lower surface of the upper insert has an identifying feature for differentiating the upper and lower surfaces of the upper insert from one another, and the upper surface of the lower insert or the lower surface of the lower insert has an identifying feature for differentiating the upper and lower surfaces of the lower insert from one another.

* * * * *